US006491537B1

(12) United States Patent
Watanabe

(10) Patent No.: US 6,491,537 B1
(45) Date of Patent: Dec. 10, 2002

(54) CONNECTING DEVICE FOR ELECTRICALLY CONNECTING FIRST AND SECOND COMPONENT BLOCKS OF A ROBOT

(75) Inventor: Hiroshi Watanabe, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/743,311

(22) PCT Filed: May 10, 2000

(86) PCT No.: PCT/JP00/02985

§ 371 (c)(1),
(2), (4) Date: Apr. 9, 2001

(87) PCT Pub. No.: WO00/69031

PCT Pub. Date: Nov. 16, 2000

(30) Foreign Application Priority Data

May 10, 1999 (JP) ..... 11-129273

(51) Int. Cl.[7] ..... H01R 11/22
(52) U.S. Cl. ..... 439/266
(58) Field of Search ..... 439/266, 862, 439/259, 310, 267, 260

(56) References Cited

U.S. PATENT DOCUMENTS 5,173,058 A * 12/1992 Broeksteeg et al. ..... 439/267
5,290,192 A * 3/1994 Espenshable et al. ..... 439/266

FOREIGN PATENT DOCUMENTS

GB 2241390 * 1/1991 ..... H01R/13/00
JP 63-146977 9/1988
JP 1-145069 10/1989
JP 4-284349 10/1992
JP 10-189132 7/1998
JP 10-315180 12/1998
WO WO 98/52724 11/1998

* cited by examiner

*Primary Examiner*—Neil Abrams
*Assistant Examiner*—J. F. Duverne
(74) *Attorney, Agent, or Firm*—Frommer Lawrence & Haug LLP; William S. Frommer; Matthew K. Ryan

(57) ABSTRACT

A connecting device that electrically connects first and second component blocks of a robot which includes an electrode projection hole provided in a connecting section of the first component block facing the second component block and an electrode terminal provided inside the first component block corresponding to the electrode projection hole. An electrode is provided in a connecting face of the second component block facing the electrode projection hole of the first component block. In applicant's connecting device, an electrode terminal driving member drives the electrode terminal so that, in accordance with a connecting action and a detaching action of the first and second component blocks, a corresponding section of the electrode terminal is projected outside the first component block through the electrode projection hole at the time of the connecting action. However, the electrode terminal driving member drives the corresponding section of the electrode terminal so as to be contained in the first component block through the electrode projection hole at the time of the detaching action.

4 Claims, 19 Drawing Sheets

A

B

A

B

A

B

CONNECTING DEVICE FOR ELECTRICALLY CONNECTING FIRST AND SECOND COMPONENT BLOCKS OF A ROBOT

TECHNICAL FIELD

The present invention relates to a connecting device and a robot, and is suitable for application to, for example, a robot configured by connecting a plurality of component blocks, that is, a modular robot.

BACKGROUND ART

Conventionally, for example, as shown in FIG. 20, a connector 1 is configured by a first half connector body 3 where a plurality of electrode terminals 2 are formed with projecting, and a second connector half body 5 where electrodes (pads) 4 are formed with being made to correspond to respective electrode terminals 2.

In a modular robot using such a connector 1, the first and second half connector bodies are located on each connecting surface of a first and second component blocks with being aligned, and it is intended to be able to electrically connect the first and second component blocks by each electrode terminal 2 of the first half connector body 3 contacting with each electrode 4 of the second half connector body 5 through the first and second half connector bodies 3 and 5 being made to push each other when the first and second component blocks are connected.

Nevertheless, in the connector 1 having such configuration, dirt and damages easily arise on the electrode terminals 2 because each electrode terminal 2 of the first half connector body 3 always projects in the external, and hence there is a problem that the reliability of electrical connection of the first and second half connector bodies 3 and 5 is low.

In addition, in case each electrode terminal 2 of the first half connector body 3 always projects in the external, there is such a possibility that an electrical shock or an injury arises by a user touching this electrode terminal 2, and hence, there is also such a problem that safety is low.

DISCLOSURE OF THE INVENTION

The present invention is achieved in consideration of the above-described points, and will propose a connecting device and a robot that can improve the reliability and safety of electrical connection.

In order to solve these problems, in the present invention, in a connecting device to electrically connect first and the second component blocks of the robot to each other, electrode terminal driving means to drive electrode terminals is provided so as to project a corresponding section of each electrode terminal outside the first component block through an electrode projection hole at the time of a connecting action, and to contain the corresponding section of each electrode terminal in the first component block through the electrode projection hole at the time of a detaching action, with corresponding to the connecting action and detaching action of the first and second component blocks.

In consequence, in this connecting device, since the electrode terminals are concealed in the first component block when the first and second component blocks are not connected, it is possible to prevent dirt and a damage of the electrode terminals, and the occurrence of user's electrical shock and injury, which are caused by the user touching the electrode terminals, beforehand and surely.

Furthermore, in the present invention, in a robot configured by connecting the first and second component blocks, electrode terminal driving means to drive electrode terminals is provided so as to project a corresponding section of each electrode terminal outside the first component block through an electrode projection hole at the time of a connecting action, and to contain the corresponding section of each electrode terminal in the first component block through the electrode projection hole at the time of a connecting action, with corresponding to the connecting action and detaching action of the first and second component blocks.

In consequence, in this robot, since the electrode terminals are concealed in the first component block when the first and second component blocks are not connected, it is possible to prevent dirt and a damage of the electrode terminals, and the occurrence of user's electrical shock and injury, which are caused by the user touching the electrode terminals, beforehand and surely, and hence, it is possible to realize a connecting device which can improve the reliability and safety of electrical connection.

BEST MODE FOR CARRYING OUT THE INVENTION

Hereinafter, an embodiment of the present invention will be described in detail with reference to drawings.

(1) Configuration of Connector According to this Embodiment

Figure 1:
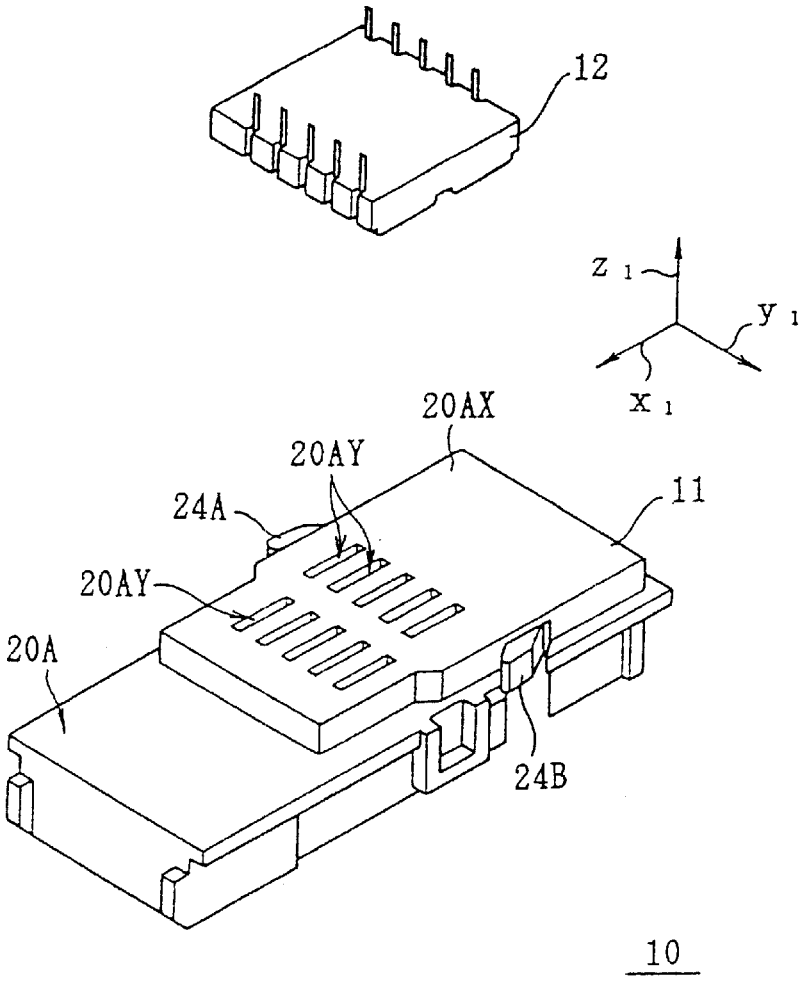
FIG. 1 is a perspective view showing the configuration of a connector according to a first embodiment.

In FIG. 1, reference numeral 10 denotes a connector according to this embodiment as a whole, and the connector consists of first and second half connector bodies 11 and 12.

In the first half connector body 11, an opening side of a housing 20 is blocked by a cover 25, simultaneously, a step section 20AX is provided in an opposite face 20A of the housing 20 facing to the second half connector body 12, and a plurality of electrode projection holes 20AY are bored so as to be arranged in two lines in the step section 20AX.

Figure 2:
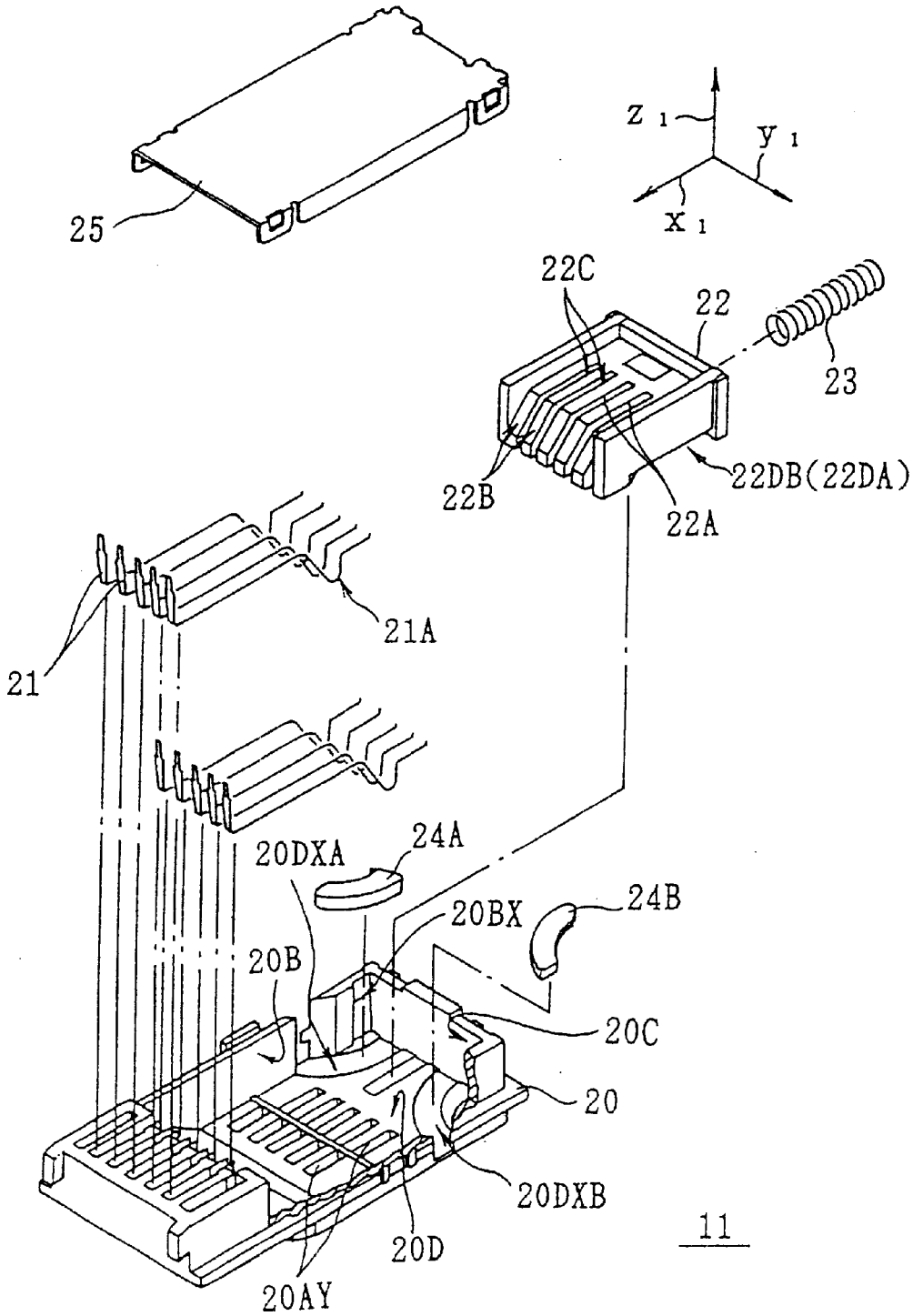
FIG. 2 is an exploded perspective view showing the configuration of a first half connector body according to the first embodiment.

In addition, inside the housing 20, as shown in FIG. 2, with being let to correspond to each electrode projection hole 20AY, the plurality of electrode terminals 21 made of elastic material having electro-conductivity are arranged in parallel in predetermined pitches along a longitudinal direction of the housing 20.

In this case, an end section of each electrode terminal 21, which is bent in an L-shape, is fixed in the housing 20, and sections, projecting downward than the housing 20 (a direction opposite to a direction shown by an arrow $z_1$), in these end sections of respective electrode terminals 21 function as contact pins.

In addition, in another end side of each electrode terminal 21, a bent portion 21A is provided by bending part of the other end section in a U-shape with being let to correspond to each electrode projection hole 20AY of the housing 20. Furthermore, in order that this bent portion 21A is energized downward by an elastic force of each electrode terminal 21 itself, a shape of the entire electrode terminals 21 is selected.

Moreover, in a rear end of the housing 20, a slider 22 is contained to be able to freely slide between an end position in a forward direction (direction shown by an arrow $x_1$), which is regulated by a stopper 20BX formed in an internal side face 20B of the housing 20, and a rear end position regulated by an internal rear face 20C of the housing 20.

Figure 3:
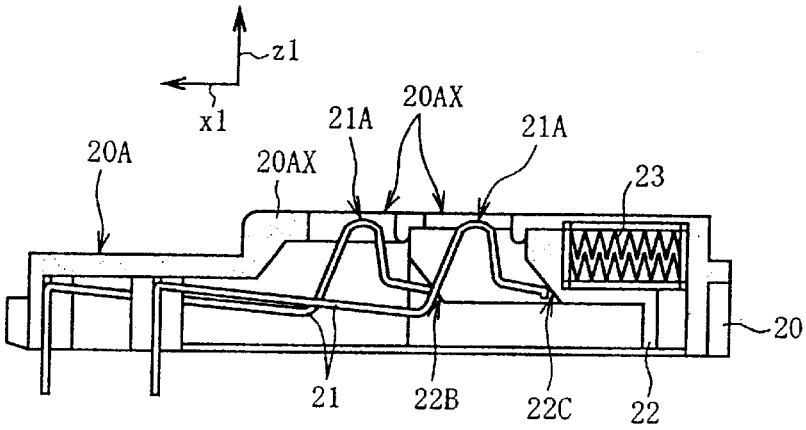
FIGS. 3A and 3B are exploded perspective views showing the configuration of the first half connector body.
Figure 3:
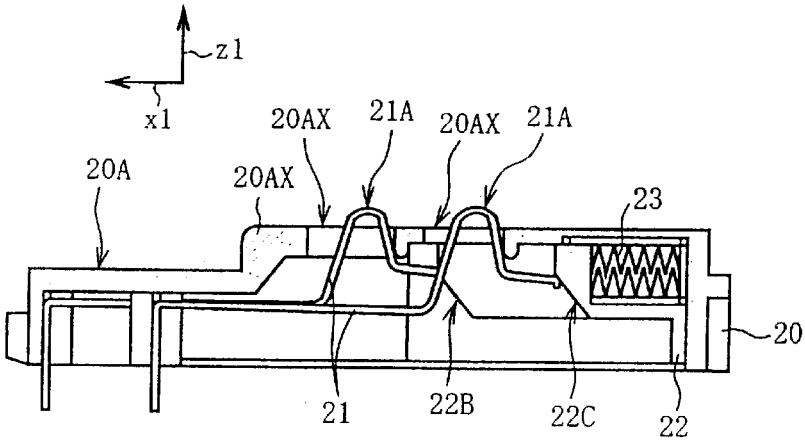

In this case, by an elastic force of a compression coil spring 23 provided between the slider 20 and internal rear face 20C of the housing 20, the slider 22 is located in a leading edge position of a movable range usually regulated by the stopper 20BX as shown in FIG. 3A.

In addition, not only a plurality of slits 22A are formed in a leading edge section of the slider 22 with being let to correspond to each electrode terminal 21 having an odd number (each electrode terminal 21 corresponding to each electrode projection hole 20AY in a rear line among electrode projection holes 20AX of the housing 20), but also inclined faces 22B and 22C which each have a predetermined angle of inclination as shown in FIG. 3A are provided in the leading edge of the slider 22 and a rear end of the slit 22A.

Furthermore, it is intended that the slider 22 not only supports another end of each corresponding electrode terminal 21 lest its bent section 21A should project outward from each corresponding electrode projection hole 20AY of the housing 20, in each of the inclined faces 22B and 22C in these leading edge and rear end of each slit when being positioned in the leading edge position of the movable range as shown in FIG. 3A, but also the slider 22 can support another end of each electrode terminal 21 in such a state that its bent section 21A projects outward only in predetermined height from each corresponding electrode projection hole 20AY of the housing 20, in each of the inclined faces 22B and 22C when being positioned in a trailing edge position of the movable range as shown in FIG. 3B.

Figure 4:
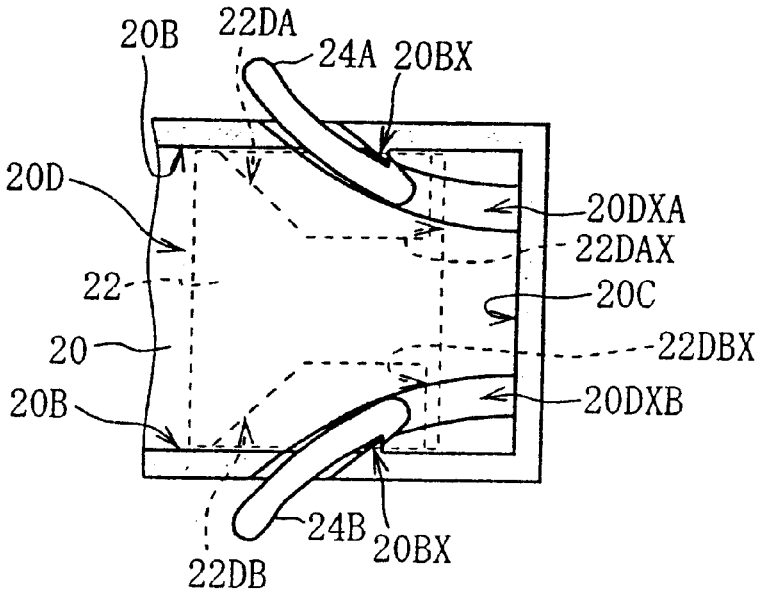
FIGS. 4A and 4B are cross sections showing the configuration of a cam mechanism in the first half connector body.
Figure 4:
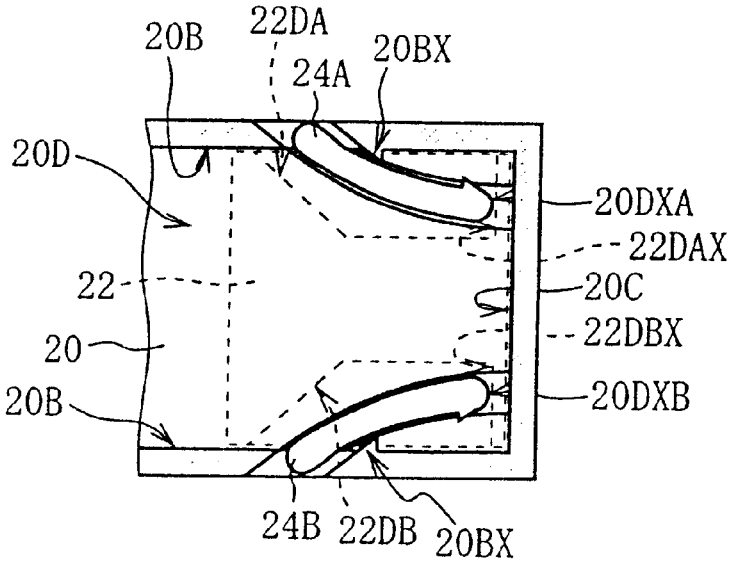

Moreover, as is clear in FIGS. 2, 4A and 4B, not only a pair of first and second grooves 22DXA and 22DXB each having an elliptical arc shape is formed in an internal top face 20D of the housing, but also first and second concavities 22DA and 22DB each having a trapezoidal shape are formed in each face of both end sections of the slider 22 in a cross direction (direction shown by an arrow $y_1$), the face facing an internal top face 20B of the housing 20, with facing the first and second concavities 22DA and 22DB to these.

In addition, in each space surrounded by these first and second concavities 22DA, 22DB of the slider 22 and an internal top face 20D of the housing 20, first and second levers 24A and 24B each having an almost circular arc shape are arranged with being freely slidable along the first and second grooves 22DXA and 22DXB of the internal top face 20D of the housing 20.

In this case, the length of the first and second levers 24A and 24B is selected so that its one end section contacts to corresponding rear end faces 22DAX and 22DBX of the first and second concavities 22DA and 22DB of the slider 22 and further an end portion of another end section projects outside the housing 22 when the slider 22 is positioned in the leading edge position of the movable range (FIG. 3A), and on the other hand, the end section contacts to the corresponding rear end faces 22DAX and 22DBX of the first and second concavities 22DA and 22DB of the slider 22, and further an end portion of the other end section becomes flush with an outer side face of the housing 22 when the slider 22 is positioned in the trailing edge position of the movable range (FIG. 3B).

Owing to this, in the first half connector body 11, it becomes possible to slide and move the slider 22 in a rear direction (direction opposite to the direction shown by an arrow $x_1$) with opposing an elastic force of the compression coil spring 23 by pushing these entire first and second levers 24A and 24B inside the housing 20 through applying external forces to the first and second levers 24A and 24B.

In addition, in the first half connector body 11, it is intended that it is possible to move the end portion of each electrode terminal 21 upward (direction shown by an arrow $z_1$) along the corresponding inclined faces 22B and 22C of the slider 22 by letting the slider 22 slide and move backward in this manner, and hence, and to displace the end portion of the bent section 21A of each electrode terminal 21 so that the end portion of the bent section 21A projects outward through each corresponding electrode projection hole 20AX of the housing 20.

Figure 5:
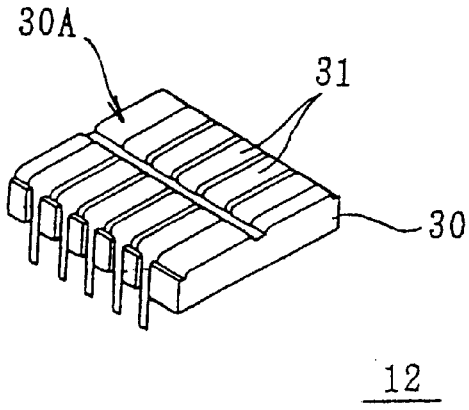
FIG. 5 is a perspective view showing the configuration of a second half connector body.

On the other hand, the second half connector body 12, as shown in FIG. 5, is configured in that a plurality of flat electrodes (pads) 31 made of electrically conductive material are provided in two parallel lines in an opposite face 30A, facing the first half connector body 11, of a base 30 made of insulating material with being let to correspond to each electrode projection hole 20AX of the housing 20 in the first half connector body 11.

Owing to this, in this connector 10, it is intended that it is possible to contact the bent section 21A of each electrode terminal 21 in the first half connector body 11 to each corresponding electrode 31 in the second half connector body 12 by aligning the first and second half connector bodies 11 and 12 and letting them push each other with applying an external force in a direction of pushing into the housing 20 to the first and second levers 24A and 24B of the first half connector body 11, and hence it is possible to electrically connect the first and second half connector bodies 11 and 12 to each other.

(2) Configuration of Robot According to the First Embodiment

Figure 6:
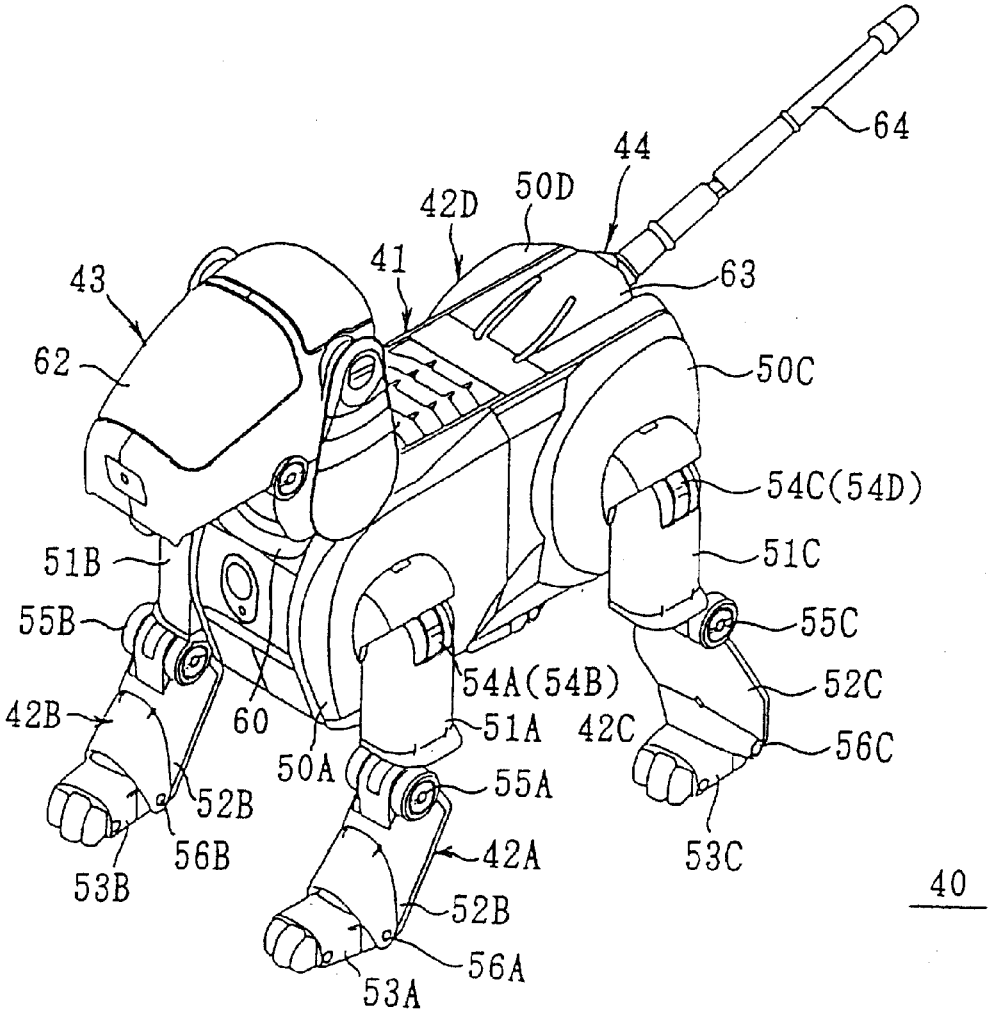
FIG. 6 is a perspective view showing the configuration of a robot according to the first embodiment.
Figure 7:
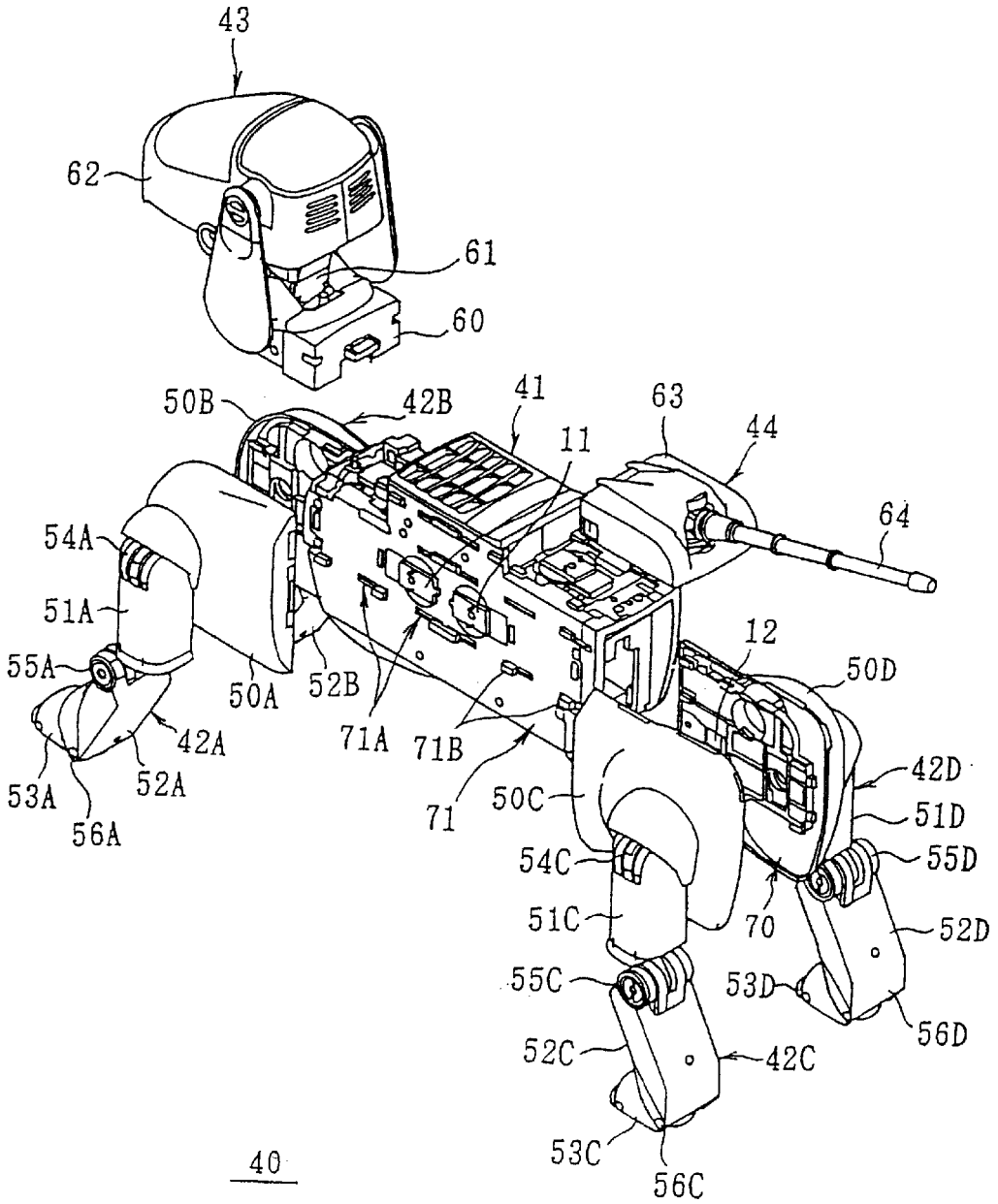
FIG. 7 is an exploded perspective view showing the configuration of the robot according to the first embodiment.

Here, FIGS. 6 and 7 show a modular robot 40 according to this embodiment, and the robot 40 is configured in that leg blocks 42A to 42D are detachably connected respectively in front, back, right, and left side faces of a body block 41, and a head block 43 and a tail block 44 are detachably connected in a front end section and a rear end section of an upper face of the body block 41 respectively.

In this case, each of the leg blocks 42A to 42D is formed by thigh units 51A to 51D, shank units 52A to 52D, and back units 53A to 53D being connected to base units 50A to 50D forming side faces of a body of the robot 40 in turn through joint mechanism sections 54A to 54D, 55A to 55D, and 56A to 56D.

In addition, the head block 43 is formed by a head unit 62 being connected through a neck unit 61 to a base unit 60 forming the leading edge section of the body of the robot 40. Furthermore, the tail block 44 is formed by a tail unit 64 being connected to a base unit 63 forming the trailing edge section of the body of the robot 40.

Figure 8:
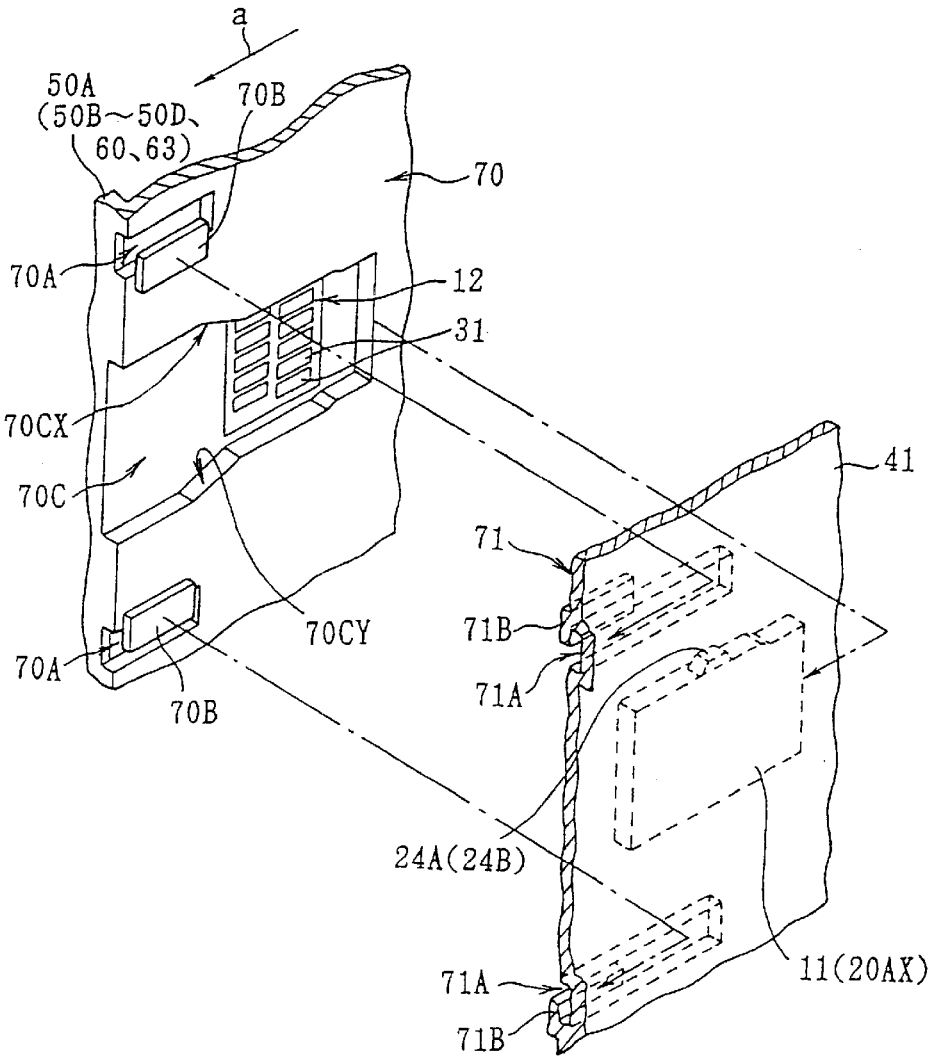
FIG. 8 is a partially perspective view for the description of the connection of a body block to another component block.

Moreover, in each of the base units 50A to 50D, 60, and 63 of the leg blocks 42A to 42D, head block 43, and tail block 44, as shown in FIG. 8,a plurality of concavities 70A are formed in each connecting face 70 with the body block 41, and further, a plurality of first fixing projection 70B are provided so as to cover one end side of each of these concavities 70A in a cross direction.

In addition, in a face 71 connecting with each of the base units 50A to 50D, 60, and 63 of the leg blocks 42A to 42D, head block 43, and tail block 44 in the body block 71, a plurality of concavities 71A are formed with being let to correspond to each first fixing projection 70B of the leg blocks 42A to 42D, head block 43, and tail block 44, and further, a plurality of second fixing projections 71B are provided so as to cover another end side of each of these concavities 71A in a cross direction.

Figure 11:
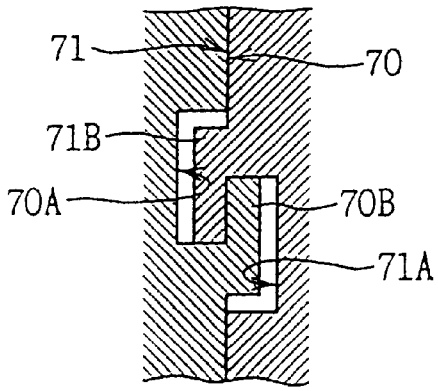
FIG. 11 is a cross section for the description of the connection of the body block to the other component block.
Figure 9:
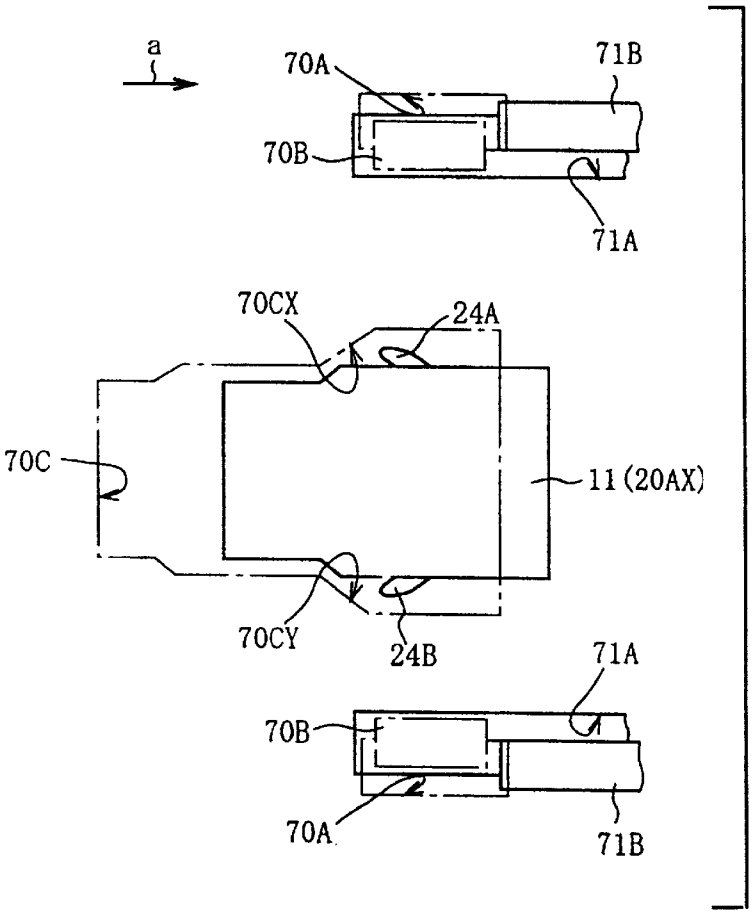
FIG. 9 is a top view for the description of the connection of the body block to the other component block.
Figure 10:
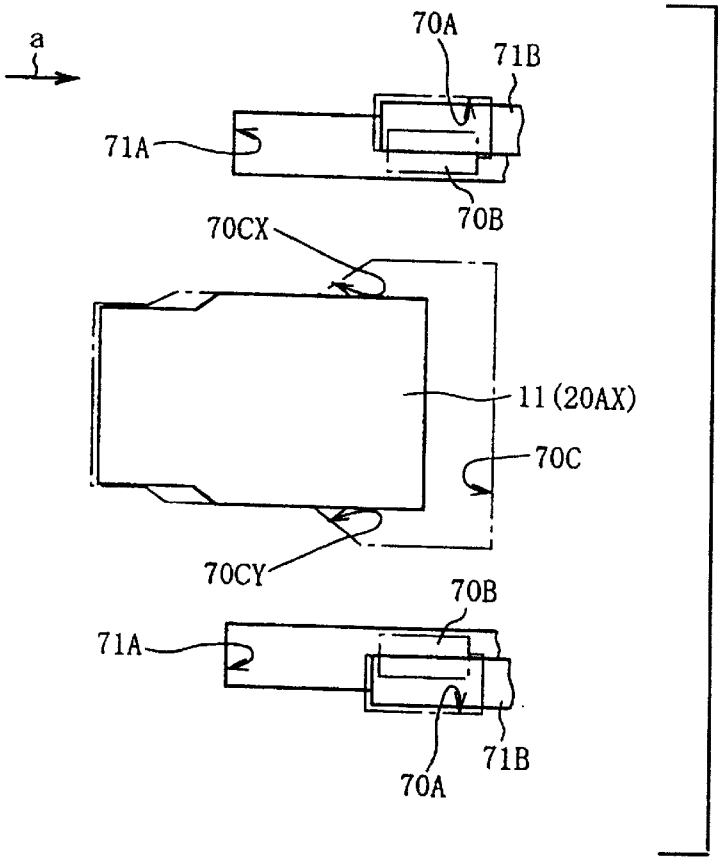
FIG. 10 is a top view for the description of the connection of the body block to the other component block.

Owing to this, in this robot 40, it is intended that it is possible to physically connect each of the leg blocks 42A to 42D, head block 43, and tail block 44 to the body block 41 by fitting each of the leg blocks 42A to 42D, head block 43, and tail block 44 in the body block 41, as shown in FIGS. 8 and 9 respectively, through fitting each first fixing projection 70B of the respective base units 50A to 50D, 60, and 63 of the leg blocks 42A to 42D, head block 43, and tail block 44 in each corresponding concavity 71A of the body block 41, and engaging the first and second fixing projections 70B and 71B as shown in FIGS. 10 and 11 through sliding each of the leg blocks 42A to 42D, head block 43, and tail block 44 in a direction shown by an arrow "a" from this state.

In addition, as shown in FIGS. 8 and 9, in each connecting face 70 of the respective base units 50A to 50D, 60, and 63 of the leg blocks 42A to 42D, head block 43, and tail block 44 to the body block 41, a connector fitting concavity 70C is formed, the connector fitting concavity 70C having an end portion with the almost same shape as that of the step section 20AX of the housing 20 in the first half connector body 11 out of the above-described connectors 10.

Furthermore, inside each of these base units 50A to 50D, 60, and 63 of the leg blocks 42A to 42D, head block 43, and tail block 44, the second half connector body 12 of above-described connector 12 is contained so that each electrode face is exposed from an opening section formed in a predetermined position of a bottom face of this connector fitting concavity 70C.

Moreover, in each connecting face 71 of the body block 41 connecting to each of the base units 50A to 50D, 60, and 63 of the leg blocks 42A to 42D, head block 43, and tail block 44, as shown in FIG. 8, the first half connector body 11 in the above-described connector 11 is provided so that only the step section 20AX projects from a mounting face 71 of the body block 71 with being let to correspond to each connector fitting concavity 70 of the leg blocks 42A to 42D, head block 43, and tail block 44.

At this time, a position of the first half connector body 11 is selected so that part of the step section 20AX fits into a corresponding connector fitting concavity 70C as shown in FIG. 9 when each of the leg blocks 42A to 42D, head block 43, and tail block 44 is connected to the body block 41 as shown in FIG. 3A, and an end portion of the step section 20AX fits into an end portion of each corresponding connector fitting concavity 70C as shown in FIG. 10 when the first and second fixing projections 70B and 71B are engaged with each other by sliding each of the leg blocks 42A to 42D, head block 43, and tail block 44 in a direction shown by an arrow "a" from this state.

In addition, at this time, it is intended that, since first and second inclined faces 70CX and 70CY are provided in each connector fitting concavity 70C as shown in FIG. 10 with being let to correspond to the first and second levers 24A and 24B of the first half connector body 11, it is possible to push the first and second levers 24A and 24B of the first half connector body 11, sliding on these first and second inclined faces 70CX and 70CY, into the housing 20 of the first half connector body 11 by the first and second inclined faces 70CX and 70CY when the first half connector body 11 is fitted into the connector fitting concavity 70C as shown in FIG. 10.

Owing to this, in this robot 40, as described above, when each of the legblocks 42A to 42C, headblock 43, and tail block 44 is connected to the body block 41 respectively, the corresponding second half connector body 11 of the body block 41 fits into each connector fitting concavity 70C of the leg blocks 42A to 42D, head block 43, and tail block 44 with projecting each electrode terminal 21 from each electrode projection hole 20AY (FIG. 1), and these contact with the corresponding electrodes 31 of the first half connector body 12.

Owing to this, it is intended that it is possible that, in the robot 40, electric connection is also performed when each of the leg blocks 42A to 42D, head block 43, and tail block 44 is physically connected to the body block 41, and hence, a control system contained in the body block 41 controls the drive of electronic parts such as actuators contained in each of the leg blocks 42A to 42D, head block 43 and tail block 44 through the connector 1, and fetches signals outputted from electronic parts such as touch sensors or cameras which are contained in each of the leg blocks 42A to 42D, head block 43, and tail block 44 through the connector 10.

(3) Action and Effect of the First Embodiment

In the above-described configuration, in this robot 40, at the time of a connecting action of each of the leg blocks 42A to 42D, head block 43, and tail block 44 to the body block 41, the first and second levers 24A and 24B of: the first half connector body 11 are gradually pushed into the housing 20 along the corresponding first and second inclined faces 70CX and 70CY of the connector fitting concavity 70C, and in connection with this, each electrode terminal 21 of the first half connector body 11 gradually projects from the housing 20 through each corresponding electrode projection hole 20AY to the external, and finally, each of these electrode terminals 21 contacts with each corresponding electrode 31 of the second half connector body 12.

On the other hand, at the time of a detaching action of each of the leg blocks 42A to 42D, head block 43, and tail block 44 from the body block 41, the first and second levers 24A and 24B of the first half connector body 11 gradually begin to close in from the housing 20 along the corresponding first and second inclined faces 70CX and 70CY of the connector fitting concavity 70C, and in connection with this, each electrode terminal 21 of the first half connector body 11 is contained in the housing 20 through each corresponding electrode projection hole 20AY, and in a final destination, each of these electrode terminals 2.1 is completely taken in inside the housing 20.

Therefore, in this robot 40, since each electrode terminal 21 of the first half connector body 11 is concealed in the housing 20, when each of the leg blocks 42A to 42D, head block 43, and tail block 44 is not connected to the body block 41, for example, dirt and damage are easy to arise in each electrode terminal 21, and in addition, it is possible to prevent an electrical shock or an injury, which arises by a user touching this. electrode terminal 21, beforehand.

According to the above-described configuration, by being configured so that the electrode terminals 21 of the first half connector body 11 project to the external only when each of the leg blocks 42A to 42D, head block 43, and tail block 44 is connected to the body block 41, dirt and damage may arise in each electrode terminal 21, and it is possible to prevent the occurrence of user's electrical shock and injury, which are caused by the user touching this electrode terminal 21, beforehand and surely, and hence, it is possible to realize a robot which can remarkably improve the reliability and safety.

(4) Configuration of Connector According to Second Embodiment

Figure 12:
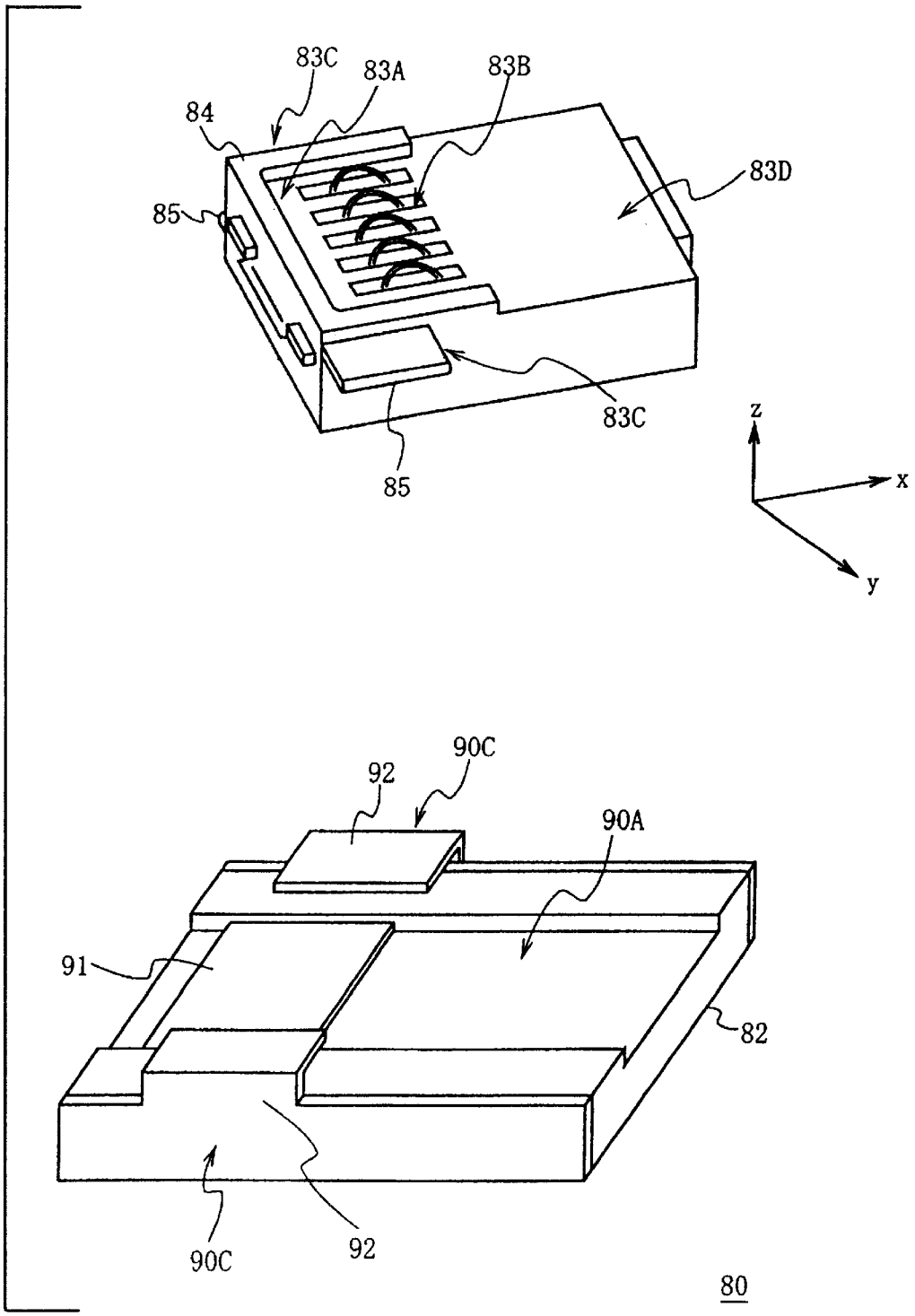
FIG. 12 is a perspective view showing the configuration of a connector according to a second embodiment.

In FIG. 12, reference numeral 80 denotes a connector according to a second embodiment as a whole, the connector consisting of first and second half connector bodies 81 and 82.

In the first half connector body 81, a step section 84 with an angular U-shape is provided in a rear plane section 83A of a housing 83 in a forward direction (direction of the X-axis) with fitting a corner portion of the step section 84 with a corner portion of the housing 83, and both side sections of the step section 84 are formed to the almost half length of the housing 83 along a longitudinal direction of the housing 83.

In addition, a plurality of electrode projection holes 83B are bored in the rear plane section 83A surrounded by the step section 84.

Furthermore, in both rear side face sections 83C of the housing 83, each projection flat plate 85 is provided in the same height as a horizontal position of the rear plane section 83A in a direction of height (direction of the Z-axis).

Figure 13:
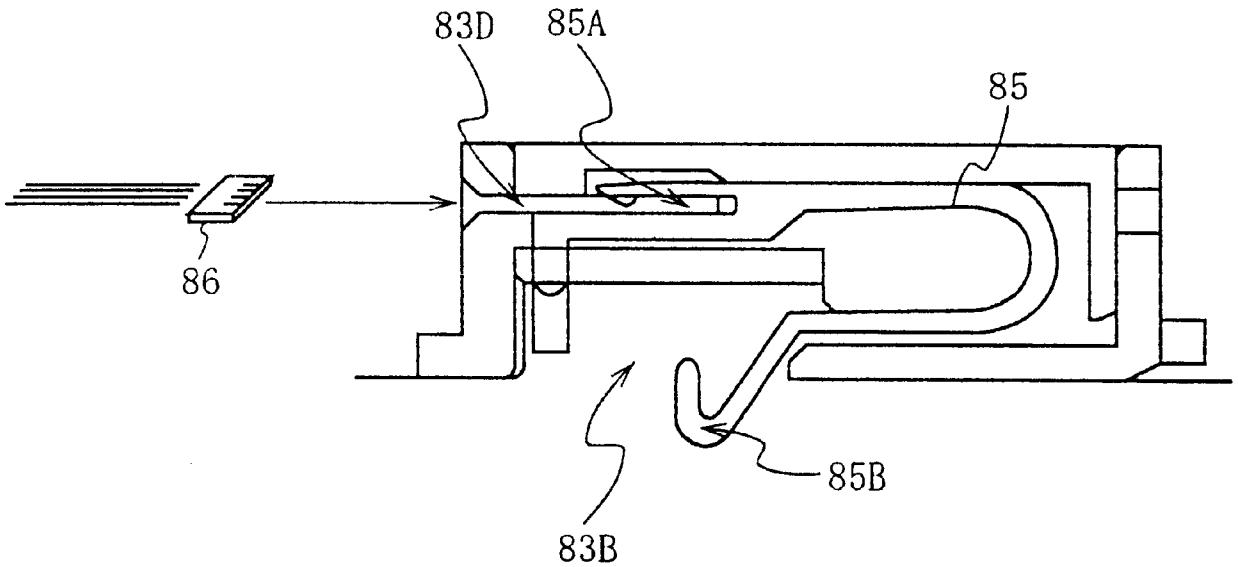
FIG. 13 is an exploded perspective view showing the configuration of a first half connector body.
Figure 14:
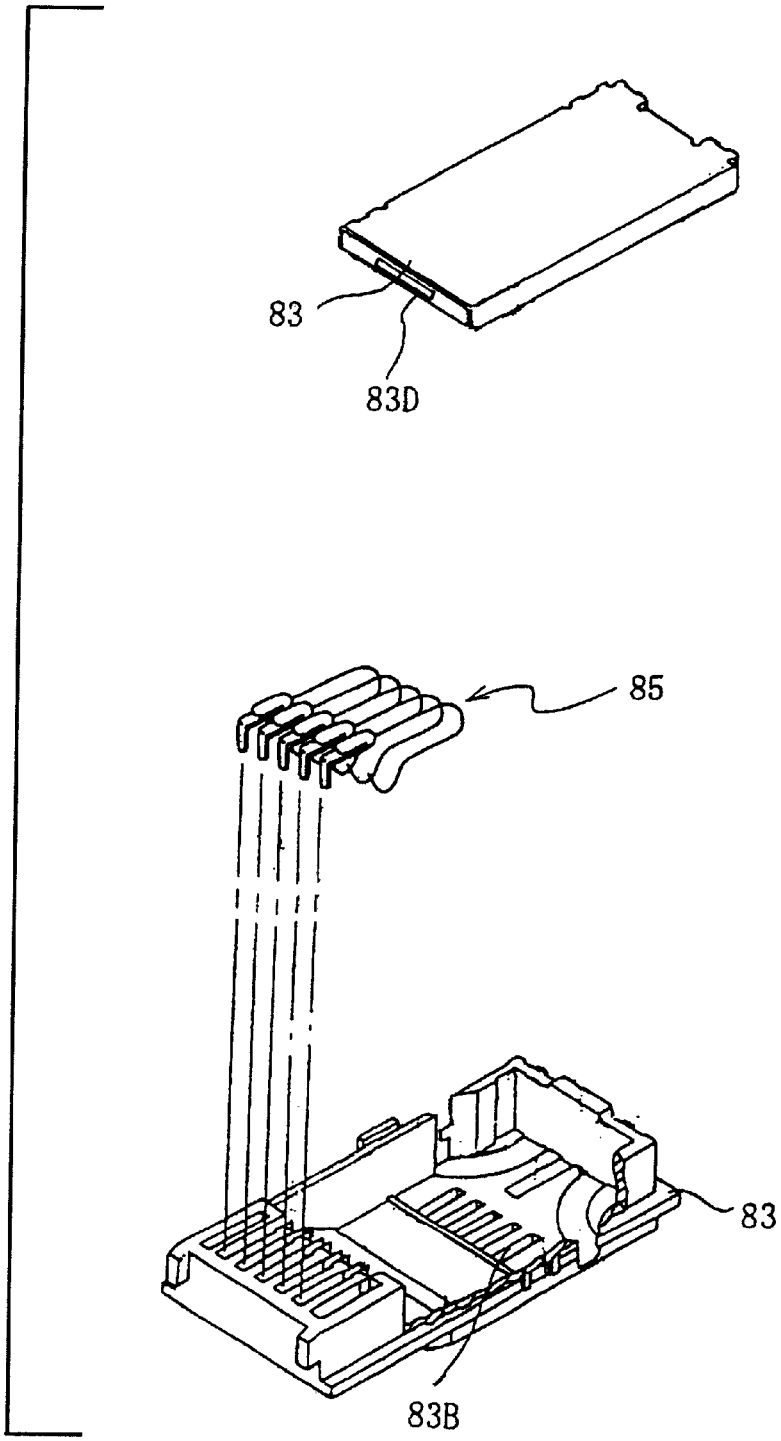
FIG. 14 is an exploded perspective view showing the configuration of the first half connector body.

Moreover, inside the housing 83, as shown in FIG. 13, a plurality of electrode terminals 85 made of elastic material having electro-conductivity are arranged in parallel in predetermined pitches along a longitudinal direction of the housing 83 with being let to correspond to each electrode projection hole 83B.

In this case, a gap to the extent of a terminal block being inserted (hereinafter, this end section is called a fitting port 85A) is provided in one end section of each electrode terminal 85, and a bottom portion of this fitting port 85A is bent in an L-shape, and is fixed into the housing 83.

Moreover, in another end of each electrode terminal 85, a bent section 85B is provided by bending part of the end of each electrode terminal 85 in a U-shape with facing each facing electrode projection hole 83B of the housing 83. In addition, a shape as the entire electrode terminal 85 is selected so that this bent section 85B energizes itself downward than a bottom of the housing 83 by an elastic force of each electrode terminal 85 itself.

Furthermore, it is intended that, since the housing 83 has an opening section 83D, which a flexible substrate 86 that is a terminal block can pass, at a position facing to the fitting port 85A of each electrode terminal 85, the flexible substrate 86 can be led to the fitting port 85A of each electrode terminal 85 through the opening section 83D.

Owing to this, the flexible substrate 86 and electrode terminals 85 are connected through the fitting port 85A.

On the other hand, in the second half connector body 82, a housing 90 is made of insulating material such as plastic, and a concavity having the same width as the width (direction of the Y-axis) of the first half connector body 81 is formed in an opposite face 90A of the housing 90 facing to the first half connector body 81.

In addition, in the second half connector body 82, electrode projection holes 90B similar to the electrode projection holes 83B are provided in the opposite face 90A of the housing 90 with facing to the electrode projection holes 83B of the housing 83 in the first half connector body 81, and a slide cover 91 made of insulating material is provided above the electrode projection holes 90B.

It is intended that this slide cover 91 is usually positioned above the electrode projection holes 90B by a coil spring not shown, and slides forward when an external force is applied forward.

Furthermore, in the housing 90, a fitting cover 92 made of rigid material bent in an L-shape is mounted for this slide cover 91 in both adjacent side faces 90C.

Figure 15:
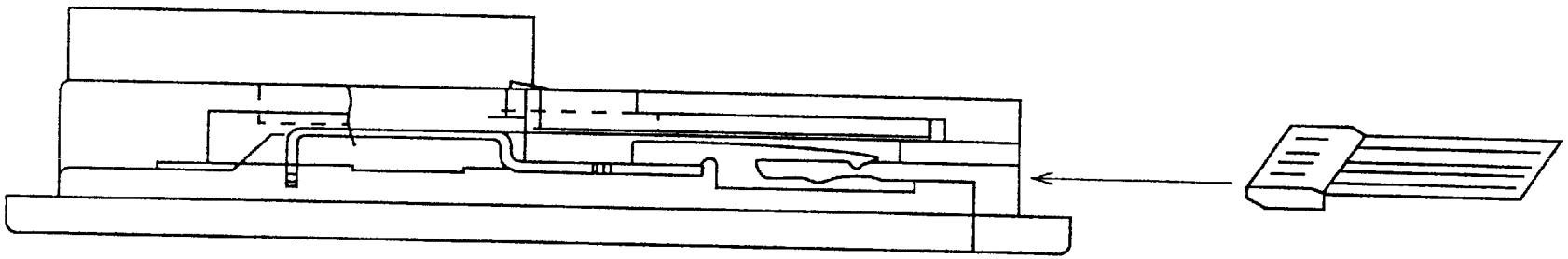
FIG. 15 is an exploded perspective view showing the configuration of a second half connector body.

Moreover, a plurality of flat electrodes (pads) 93A made of electrically conductive material are provided inside the housing 90 with being let to correspond to each electrode projection hole 90B, as shown in FIG. 15.

In this case, each electrode 93A consists of a projecting face of a convex portion formed by an end section of each electrode terminal 93 being convexly bent, and this convex portion is fixed inside the housing 90 so as to face to each electrode projection hole 90B.

In addition, a fitting port 93B configured similarly to each fitting port 85A of the above-described electrode terminals 85 is provided in another end of each electrode terminal 93.

Furthermore, it is intended that, since the housing 90 has an opening section 90D, which a flexible substrate 94 that is a terminal block can pass, at a position facing to the fitting port 93B of each electrode terminal 93, the flexible substrate 94 can be led to the fitting port 93B of each electrode terminal 93 through the opening section 90D.

In consequence, it is intended that, in the first and second half connector bodies 81 and 82, by the flexible substrates 86 and 94 being connected to the electrode terminals 85 and 93 through the fitting port 85A and 93B, it is not necessary to connect the electrode terminals 85 and 93 to the flexible substrates 86 and 94 by soldering in comparison to the above-described first embodiment, and hence, electrical stability is increased by deleting an electrical contact failure caused by separation in a connected part by solder, and further it is possible to miniaturize the first and second half connector bodies 81 and 82 by each space occupied by soldering.

Figure 16:
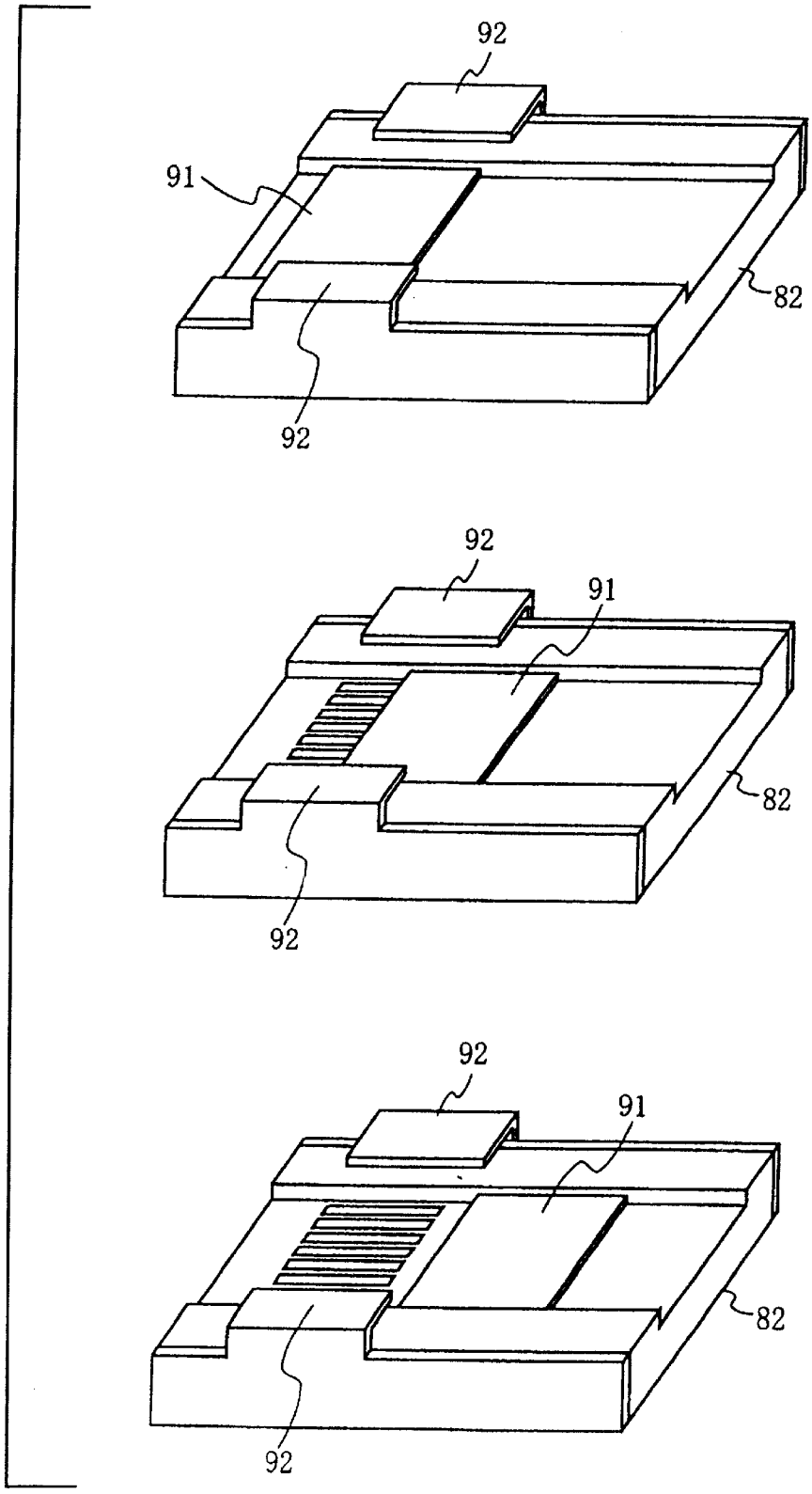
FIG. 16 is a perspective view showing a state of a slide cover moving.

Actually, it is intended that, in the second half connector body 82, in case the first half connector body 81 is fitted along this concavity, as shown in FIG. 16, first, the first half connector body 81 is pushed toward a fitted-into direction (X-direction), and when the step section 84 of this contacts with the slide cover 91, the slide cover 91 is slid in an inserted direction according to quantity pushed after the contact.

Figure 17:
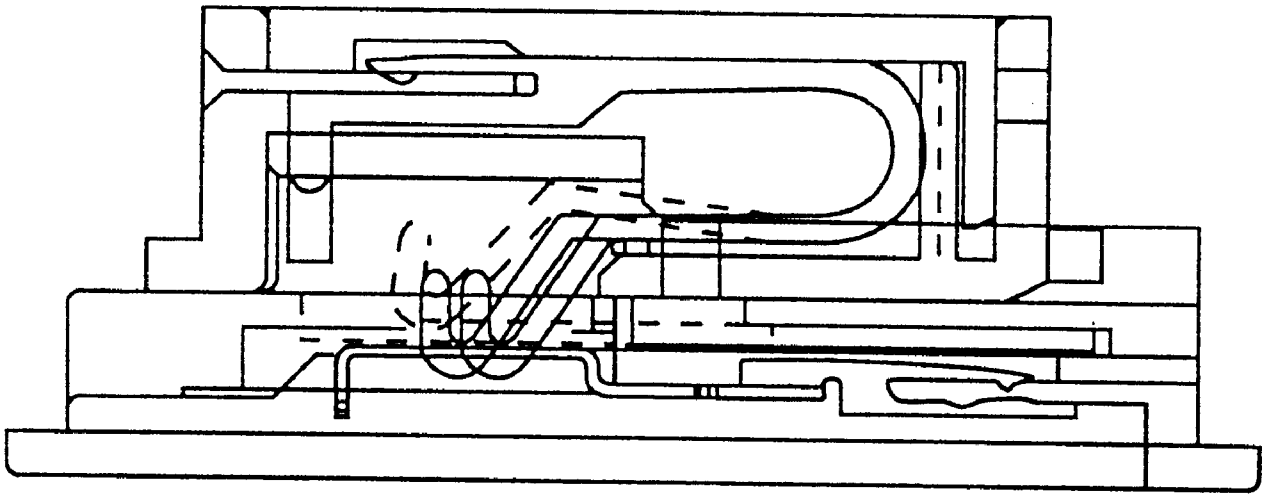
FIG. 17 is a perspective view showing the configuration of the connector according to the second embodiment.

Here, it is intended that, as shown FIG. 17, the slide cover 91 is usually positioned at a position of covering each electrode projection hole 90B and is slid in the fitted-into direction by the step section 84 of the first half connector body 81, and when the first half connector body 81 is completely fitted in the second half connector body 82 (hereinafter, this is called fitted-into time), the slide cover 91 is slid in the fitted-into direction just by the length of both side sections of the step section 84 and the electrodes (pads) which are usually covered are exposed.

Then, it is intended that the slide cover 91 is positioned in a front plane section 83D of the first half connector body 81, and at this time, because the height of the slide cover 91 is equal to the height of the step section 84, the second half connector body 82 stably supports the first half connector body 81.

In addition, in this manner, it is intended that, since the projecting flat plate 85 of the first half connector body 81 is fitted in the fitting cover 95 of the second half connector body 82 when the first half connector body 81 is fitted into the second half connector body 82, and actually, if the connector 80 consisting of the first half connector body 81 and second half connector body 82 is used for, for example, the leg blocks 42A to 42D of the robot 40, it is possible to prevent the first half connector body 81 and second half connector body 82 from disconnecting from each other in a direction of vibration (direction of the Y-axis) by the vibration generated when the robot 40 moves.

Owing to this, in this connector 80, it is intended that, by fitting the first and second half connector bodies 81 and 82 in each other after alignment with fitting the projecting flat plate 85 of the first half connector body 81 in the fitting cover 92, the bent section 85B of each electrode terminal 85 of the first half connector body 81 can contact to each corresponding electrode 93A of the second half connector body 82, and hence, it becomes possible to electrically connect the first half connector body 81 and second half connector body 82 to each other.

Therefore, it is intended that it is possible to send a signal S1, inputted from the flexible substrate 86 connected to the first half connector body 81, to the flexible substrate 94 connected to the second half connector body 82 through the electrodes terminal 85 and electrode 93A.

(5) Configuration of Robot According to the Second Embodiment

Here, a modular robot according to the second embodiment has the same configuration as that of the modular robot 40 according to the first embodiment except part of a connector 80, and is configured in that the leg blocks 42A to 42D are detachably connected respectively in front, back, right, and left side faces of the body block 41, and the head block 43 and tail block 44 are detachably connected in the front end section and rear end section of the upper face of the body block 41 respectively.

Figure 18:
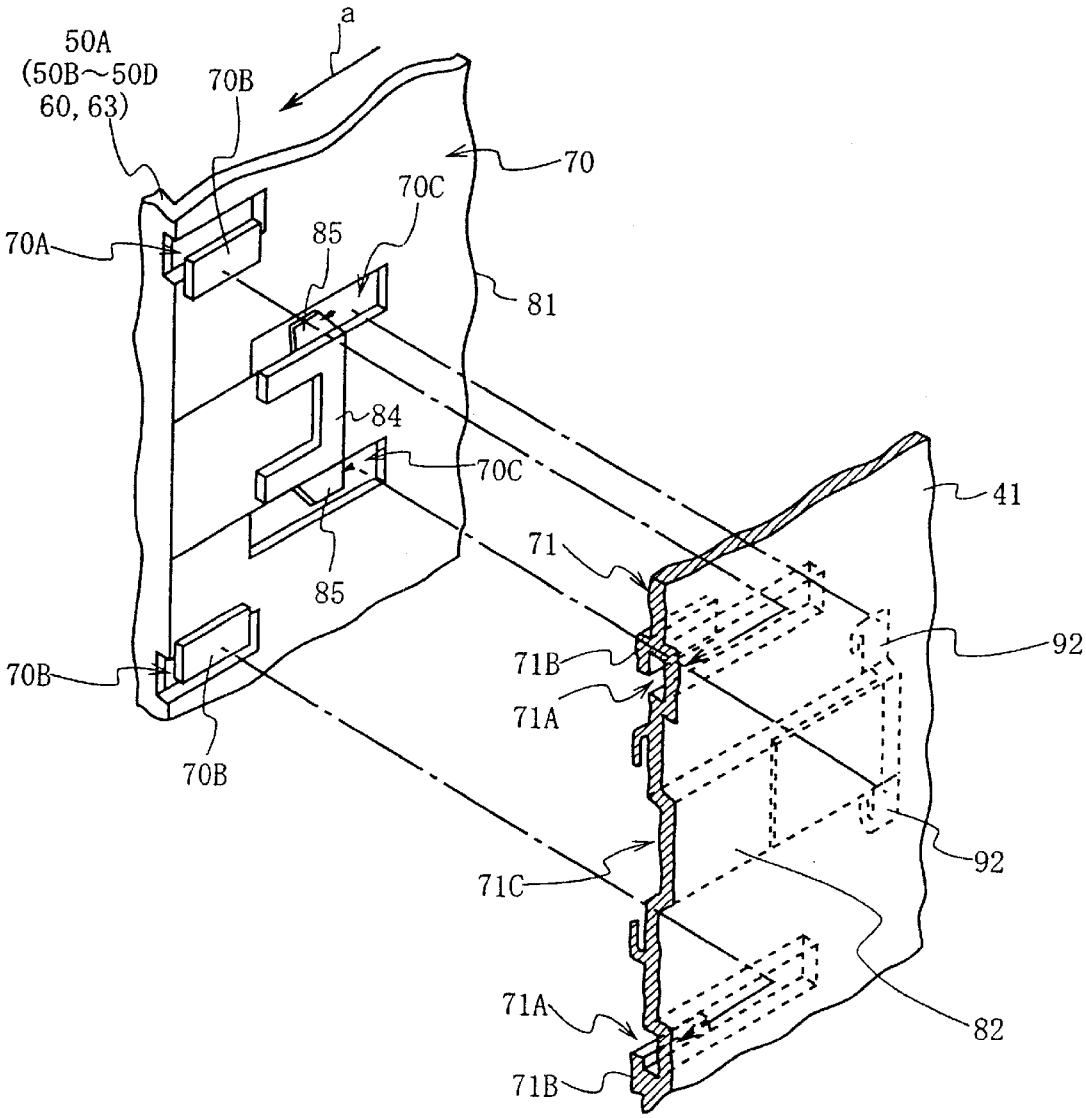
FIG. 18 is a top view for the description of connection with a component block according to the second embodiment.

In addition, in a connecting face 70 of each of the base units 50A to 50D, 60 and 63 of the leg blocks 42A to 42D, head block 43, and tail block 44 to the body block 41 according to the second embodiment, which are shown by assigning the same reference numerals as those in FIG. 8 shown in the first embodiment, as shown FIG. 18, two fitting cover concavities 70C that can contain a pair of fitting covers 92 in the second half connector body 82 out of the above-described connector 80 are formed.

Furthermore, the projecting flat plate 85 of the first half connector body 81 is positioned above these fitting cover concavities 70C inside respective base units 50A to 50D, 60 and 63 of these respective leg blocks 42A to 42D, head block 43, and tail block 44, and moreover, the first half connector body 81 of the above-described connector 80 is contained so that the step section 84 projects from the mounting face 71.

Moreover, in each connecting face 71 of the leg blocks 42A to 42D, head block 43, and tail block 44 to each of the base units 50A to SOD, 60, and 63 in the body block 41, the second half connector body 82 out of the above-described connector 80 is provided so that only the tally cover 92 projects from the mounting face 71 of the body block 71 with being let to correspond to each fitting cover concavity 70C of the leg blocks 42A to 42D, head block 43, and tail block 44, and further, a concave portion of the housing 90 and the step concavity 71C are formed.

Figure 19:
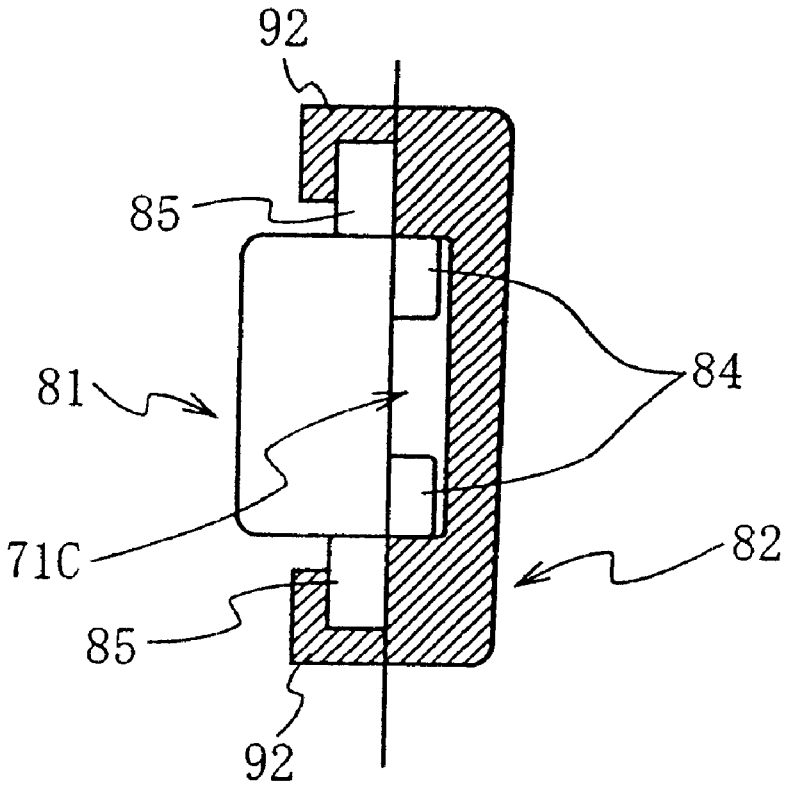
FIG. 19 is a top view for the description of connection with the component block according to the second embodiment.
Figure 20:
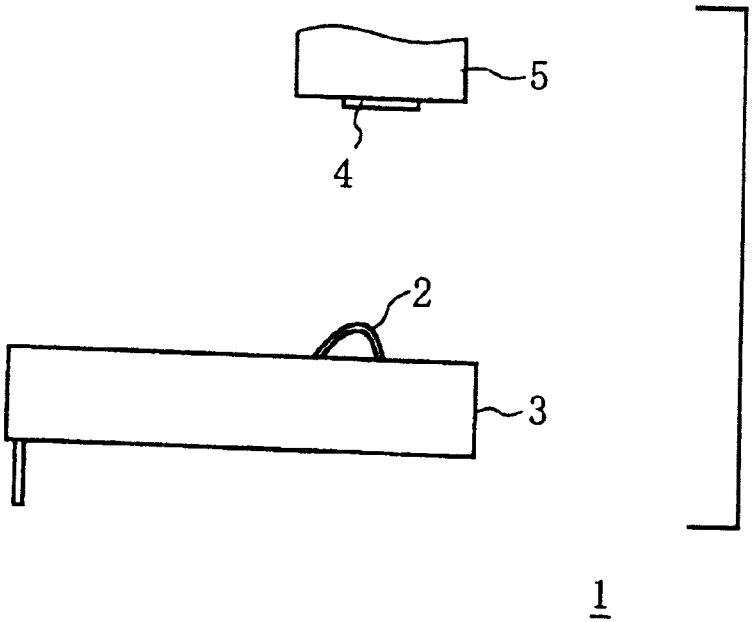
FIG. 20 is a side view showing a configuration example of a conventional connector.

At this time, in the first half connector body 81, when each of the leg blocks 42A to 42D, head block 43, and tail block 44 are fitted to the body block 41 as shown in FIG. 16, the tally cover 92 is contained in the corresponding fitting cover concavity 70C, and from this condition, by sliding each of the leg blocks 42A to 42D, head block 43, and tail block 44 in a direction shown by an arrow "a", the first and second fixing projections 70 (70A and 70B), and 71 (71A and 71B) are engaged as shown FIG. 19, and further, when the projecting flat plate 85 and fitting cover 92 are engaged with each other, the step section 84 of the first half connector body 81 fits into the step section concavity 71C of the second half connector body 82.

In addition, at this time, the slide cover 91 provided in the step section concavity 71C of the second half connector body 82 is slid.

Owing to this, in this robot 40, as described above, when each of leg blocks 42A to 42D, head block 43, and tail block 44 is connected to the body block 41, the corresponding first half connector body 81 of the body block 41 is fitted with projecting each electrode terminal 85 from each electrode projection hole 83B inside each step section concavity 71C of the leg blocks 42A to 42D, head block 43 and tail block 44, and these contact to the electrodes 93A exposed by the corresponding slide cover 91 of the second half connector body 81 sliding.

Hence, in the robot 40, it is intended that electric connection is also performed at the time of the physical connection of each of the leg blocks 42A to 42D, head block 43, and tail block 44 to the body block 41, and owing to this, a control system contained in the body block 41 controls the drive of electronic parts such as actuators contained in each of the leg blocks 42A to 42D, head block 43, and tail block 44 through the connector 1, and it is possible to fetch through a connector 80 a signal outputted from electronic parts such as a touch sensor and a camera that are contained in each of the leg blocks 42A to 42D, head block 43, and tail block 44.

(6) Actions and Effects of the Second Embodiment

In the above-described configuration, in this robot 40, the step section 84 of the first half connector body 81 is pushed along the step section concavity 71C at the time of a connecting action of each of the leg blocks 42A to 42D, head block 43, and tail block 44 to the body block 41, and in connection with this, the slide cover 91 of the second half connector body 82 slides, the electrode 93A projects in the external, and finally, these respective electrodes 93A contact with the corresponding electrode terminals 85 of the first half connector body 81.

On the other hand, the step section 84 of the first half connector body 81 gradually projects along the step section concavity 71C at the time of a detaching action of each of the leg blocks 42A to 42D, head block 43, and tail block 44 from the body block 41, and in connection with this, the slide cover 91 of the second half connector body 82 gradually slides to the usual position, and finally, the slide cover 91 protects the electrodes 93A.

Therefore, in this robot 40, since each electrode 93A of the second half connector body 82 is protected by the slide cover 91, when each of the leg blocks 42A to 42D, head block 43, and tail block 44 is not connected to the body block 41, for example, dirt and a damage are easy to arise in each electrode 93A, and in addition, it is possible to prevent an electrical shock or an injury, which arises by a user touching this electrode 93A, beforehand.

According to the above-described configuration, by being configured so that the electrodes 93A of the second half connector body 82 project to the external only when each of the leg blocks 42A to 42D, head block 43, and tail block 44 is connected to the body block 41, dirt and a damage are easy to arise in each electrode 93A, and it is possible to prevent the occurrence of user's electrical shock and injury, which are caused by the user touching this electrode 93A, beforehand and surely, and hence, it is possible to realize a robot which can remarkably improve the reliability and safety.

(7) Other Embodiments

In addition, although a case where the present invention is applied to the robot 40 configured as shown in FIG. 6 is described in the above-described embodiment, the present invention is not limited to this, but it is possible to widely apply the present invention to robots having various kinds of configuration.

Furthermore, in the above-described embodiment, a case is described, the case where electrode terminal driving means driving the electrode terminals 21 so that, with corresponding to a connecting action and a detaching action of each of the leg blocks 42A to 42D, head block 43, and tail block 44 to the body block 41, corresponding sections (bent sections 21A) of the electrode terminals 21 of the first half connector body 11 are projected through the electrode projection holes 20AY of the housing 20 outside the housing 20 at the time of the connecting action, and the corresponding sections of the electrode terminals 21 are contained in the housing 20 through the electrode projection holes 20AY at the time of the detaching action, the electrode terminal driving means including the slider 22 of the first half connector body 11, compression coiled spring 23, and first and second levers 24A and 24B, and the first and second inclined faces 70CX and 70CY of the connector fitting concavity 70C formed on each of the base units 50A to 50D, 60, and 63 of the leg blocks 42A to 42D, head block 43, and tail block 44, but the present invention is not limited to this, various kinds of configuration besides this can be broadly applied.

Moreover, although a case where the electrodes 93A of the second half connector body 82 are protected by the slide cover 91 is described in the above-described second embodiment, the present invention is not limited to this, it can be also performed to protect the electrode terminals 85 of the first half connector body 81. by the slide cover 91 of the second half connector body 82 instead of the electrodes 93A of the second half connector body 82. In this case, when each of the leg blocks 42A to 42D, head block 43, and tail block 44 is not connected to the body block 41, the slide cover 91 can protect the electrode terminals 85 by shutting the electrode terminals 85, always projecting from the housing 83 of the first half connector body 81 by their own elastic forces, up inside the housing 83.

INDUSTRIAL APPLICABILITY

The present invention can be applied to a pet robot.

What is claimed is:

1. A connecting device that electrically connects first and second component blocks of a robot comprising:

an electrode projection hole provided in a connecting section of the first component block facing the second component block;

an electrode terminal provided inside the first component block corresponding to the electrode projection hole;

an electrode provided in a connecting face of the second component block facing the electrode projection- hole of the first component block; and electrode terminal driving means for driving the electrode terminal so that, in accordance with a connecting action and a detaching action of the first and second component blocks, a corresponding section of the electrode terminal is projected outside the first component block through the electrode projection hole at the time of the connecting action, and the corresponding section of the electrode terminal is contained in the first component block through the electrode projection hole at the time of the detaching action, whereby said electrode terminal driving means does not move said connecting section of the first component block including the electrode projection hole when the electrode terminal driving means drives the electrode terminal between its projected position at the time of the connecting action and its contained position at the time of the detaching action.

2. The connecting device according to claim 1, characterized in that the electrode terminal driving means comprises:

a slider that is provided in the first component block, supports the electrode terminal lest the corresponding section of the electrode terminal should project outside the first component unit through the electrode projection hole when the slider is positioned in one end position of a movable range, and on the other hand, supports the electrode terminal so that the corresponding section of the electrode terminal projects the outside of the first component unit through the electrode projection hole when the slider is positioned in another end position of the movable range;

energizing means, provided in the first component block, for energizing the slider so that the slider is positioned in the one end position in the movable range;

a lever that is provided in the first component block and moves the slider in the other end position of the movable range with corresponding to pressing operation; and an inclined face that is provided in the second component block and that the lever slides at the time of the connecting action of the first and the second component blocks on, in which the inclined face inclines in a direction of pressing the lever at the time of the connecting action of the first and the second component blocks.

3. A robot constructed by connecting first and second component blocks, comprising:

an electrode projection hole provided in a connecting section of the first component block facing the second component block;

an electrode terminal provided inside the first component block corresponding to the electrode projection hole;

an electrode provided in a connecting face of the second component block facing the electrode projection hole of the first component block; and electrode terminal means for driving the electrode terminal so that, in accordance with a connecting action and a detaching action of the first and second component blocks, a corresponding section of the electrode terminal is projected outside the first component block through the electrode projection hole at the time of the connecting action, and the corresponding section of the electrode terminal is contained in the first component block through the electrode projection hole at the time of the detaching action, whereby said electrode terminal driving means does not move said connecting member of the first component block including the electrode projection hole when the electrode terminal driving means drives the electrode terminal between its projected position at the time of the connecting action and its contained position at the time of the detaching action.

4. The robot according to claim 3, characterized in that the slider that is provided in the first component block, supports the electrode terminal lest the corresponding section of the electrode terminal should project outside the first component unit through the electrode projection hole when the slider is positioned in one end position of a movable range, and on the other hand, supports the electrode terminal so that the corresponding section of the electrode terminal projects the outside of the first component unit through the electrode projection hole when the slider is positioned in another end position of the movable range;

energizing means, provided in the first component block, for energizing the slider so that the slider is positioned in the one end position in the movable range; and a lever that is provided in the first component block and moves the slider in the other end position of the movable range with corresponding to pressing operation; and an inclined face that is provided in the second component block and that the lever slides at the time of the connecting action of the first and the second component blocks on, in which the inclined face inclines in a direction of pressing the lever at the time of the connecting action of the first and the second component blocks.

* * * * *